US011363371B1

(12) United States Patent
Chen et al.

(10) Patent No.: US 11,363,371 B1
(45) Date of Patent: Jun. 14, 2022

(54) ELECTRONIC DEVICE

(71) Applicant: Merry Electronics(Shenzhen) Co., Ltd., ShenZhen (CN)

(72) Inventors: Hung-Wei Chen, Taichung (TW); Chun-Hung Chang, Taichung (TW); Shiang-Chun Hsu, Taichung (TW); Jin-Huang Huang, Taichung (TW); Yu-Cheng Liu, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 5 days.

(21) Appl. No.: 17/164,736

(22) Filed: Feb. 1, 2021

(30) Foreign Application Priority Data

Nov. 24, 2020 (TW) ..... 109141058

(51) Int. Cl.
*H04R 1/28* (2006.01)
*H04R 1/08* (2006.01)
*H04R 1/04* (2006.01)

(52) U.S. Cl.
CPC ..... *H04R 1/2869* (2013.01); *H04R 1/04* (2013.01); *H04R 1/08* (2013.01)

(58) Field of Classification Search
CPC ..... H04R 1/2869; H04R 1/222; H04R 1/08
See application file for complete search history.

(56) References Cited

U.S. PATENT DOCUMENTS

2019/0028786 A1* 1/2019 Grinnip, III ..... H04R 1/2807

* cited by examiner

*Primary Examiner* — Kile O Blair
(74) *Attorney, Agent, or Firm* — JCIPRNET

(57) ABSTRACT

An electronic device includes a main body, a sound guiding tube, a microphone assembly and an adjustment cavity. The device body includes a wall plate. The sound guiding tube is formed on the wall plate of the main body and includes an input end, a first output end and a second output end, and the input end is in communication with the external environment. The microphone assembly is arranged on the main body and in communication with the first output end of the sound guiding tube, and the microphone assembly is acoustically connected to the external environment. The adjustment cavity is arranged in the main body and in communication with the second output end of the sound guiding tube, and the adjustment cavity is acoustically connected to the external environment.

10 Claims, 4 Drawing Sheets

ELECTRONIC DEVICE

CROSS-REFERENCE TO RELATED APPLICATION

This application claims the priority benefit of Taiwan application serial no. 109141058, filed on Nov. 24, 2020. The entirety of the above-mentioned patent application is hereby incorporated by reference herein and made a part of this specification.

BACKGROUND OF THE INVENTION

1. Field of the Invention

The invention relates to an electronic device, and particularly relates to an electronic device including a microphone assembly.

2. Description of Related Art

When a microphone assembly receives sounds of different frequencies, the sensitivity signals that are converted may vary with frequencies, and the sensitivity value to which each frequency corresponds is known as a frequency response. In addition, a flatter curve of the sensitivity value suggests a greater sound reception fidelity at respective frequencies.

An electronic device is normally provided with a case, and an electronic device with a sound receiving function is provided with a microphone assembly inside the electronic device. The microphone assembly is acoustically connected with the external environment via a structure such as a sound guiding tube to receive sounds in the external environment. During the process in which the microphone assembly receives sounds, the reflection of acoustic waves by the case may result in a gain in the frequency response of the microphone assembly, which often needs to be compensated for by a circuit or a processor and results in a load for processing at a later stage.

SUMMARY OF THE INVENTION

The embodiments of the invention provide an electronic device capable of reducing a frequency response gain of a microphone assembly resulting from the reflection of acoustic waves by a wall plate.

An aspect of the invention provides an electronic device. The electronic device includes a main body, a sound guiding tube, a microphone assembly and an adjustment cavity. The device body includes a wall plate. The sound guiding tube is formed on the wall plate of the main body and includes an input end, a first output end and a second output end, and the input end is in communication with the external environment. The microphone assembly is arranged on the main body and in communication with the first output end of the sound guiding tube, and the microphone assembly is acoustically connected to the external environment. The adjustment cavity is arranged in the main body and in communication with the second output end of the sound guiding tube, and the adjustment cavity is acoustically connected to the external environment.

According to an embodiment of the invention, the microphone assembly has a first cavity, and a volume of the adjustment cavity is greater than a volume of the first cavity.

According to an embodiment of the invention, the adjustment cavity is ring-shaped and surrounds the sound guiding tube.

According to an embodiment of the invention, the sound guiding tube includes a first tube element and a second tube element. The sound guiding tube is connected to the microphone assembly via the first tube element and connected to the adjustment cavity via the second tube element.

According to an embodiment of the invention, a volume of the first tube element is greater than a volume of the second tube element.

According to an embodiment of the invention, the input end and the first output end are formed at the first tube element, the second output end is formed at the second tube element, and the first tube element and the second tube element are in communication with each other.

According to an embodiment of the invention, a volume of the second tube element is smaller than a volume of the adjustment cavity.

According to an embodiment of the invention, a dimension of the second tube element is smaller than a dimension of the adjustment cavity in a direction parallel to an axial direction of the first tube element.

According to an embodiment of the invention, a dimension of the second tube element is smaller than a dimension of the adjustment cavity in a direction parallel to a radial direction of the first tube element.

According to an embodiment of the invention, a volume of the adjustment cavity is defined as C, an area of a cross section of the second tube element perpendicular to a radial direction of the first tube element is defined as A, a length of the second tube element along the radial direction of the first tube element is defined as L, and C*A/L is smaller than a square of a speed of sound.

Based on the above, in the electronic device according to the embodiments of the invention, the adjustment cavity in communication with the second output end of the sound guiding tube is disposed in the main body. Therefore, during the process in which the microphone assembly receives sounds, the energy generated through the wall plate reflecting acoustic waves may be attenuated by the adjustment cavity, so as to reduce the frequency response gain resulting from the reflection of the acoustic waves by the wall plate and render a favorable sound reception fidelity.

To make the above features and advantages of the invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
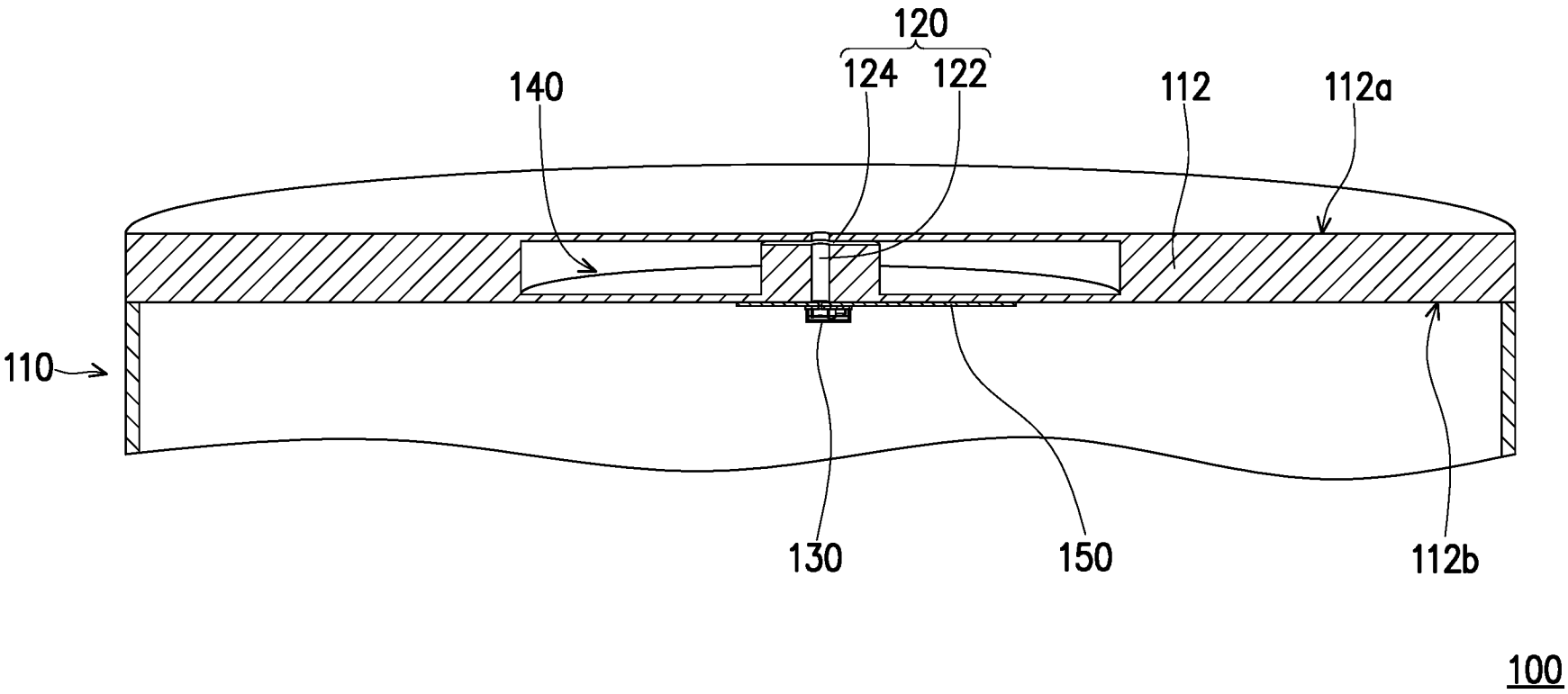
FIG. 1 is a view illustrating a partial structure of an electronic device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
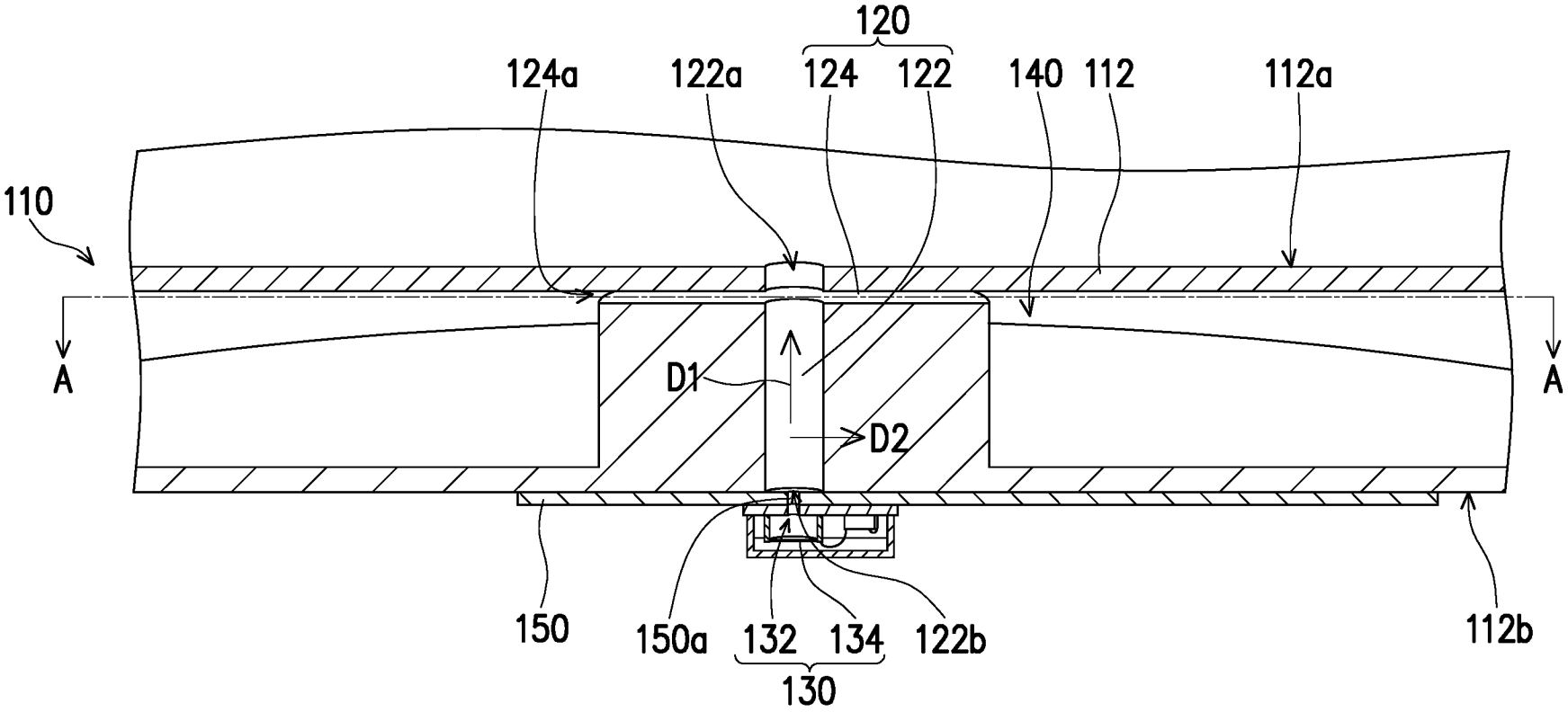
FIG. 2 is a partially enlarged view of the electronic device of FIG. 1.

FIG. 1 is a view illustrating a partial structure of an electronic device according to an embodiment of the invention. FIG. 2 is a partially enlarged view of the electronic device of FIG. 1. Referring to FIGS. 1 and 2, an electronic device 100 of the embodiment may be in any form, such as a consumer product with a sound receiving function (e.g., a smart phone, a tablet computer, etc.). FIG. 1 merely illustrates a portion of the structure of the electronic device 100 for an illustrative purpose. The electronic device 100 includes a main body 110, a sound guiding tube 120, a microphone assembly 130 and an adjustment cavity 140. The main body 110 includes a wall plate 112, and the wall plate 112 is in a circular plate shape, for example. The sound guiding tube 120 is formed on the wall plate 112 of the main body 110 and includes an input end 122*a*, a first output end 122*b* and a second output end 124*a*, and the input end 122*a* is in communication with the external environment. The microphone assembly 130 and the adjustment cavity 140 are arranged on the main body 110, and are acoustically connected with the external environment via the sound guiding tube 120.

The microphone assembly 130 is an MEMS microphone, for example, and is disposed on an inner surface 112*b* of the wall plate 112. The microphone assembly 130 has a first cavity 132 and a diaphragm 134. The first cavity 132 of the microphone assembly 130 is in communication with the first output end 122*b* of the sound guiding tube 120, and the diaphragm 134 is located in the first cavity 132.

The adjustment cavity 140 is disposed between an outer surface 112*a* and the inner surface 112*b* of the wall plate 112, and is in communication with the second output end 124*a* of the sound guiding tube 120. Therefore, during a process in which the microphone assembly 130 receives sounds, the energy generated through the wall plate 112 reflecting acoustic waves may be attenuated by the adjustment cavity 140, so as to reduce the frequency response gain resulting from the reflection of the acoustic waves by the wall plate 112 and render a favorable sound reception fidelity.

Specifically, the sound guiding tube 120 includes a first tube element 122 and a second tube element 124. The sound guiding tube 120 is connected to the microphone assembly 130 via the first tube element 122 and connected to the adjustment capacity 140 via the second tube element 124. In addition, the first tube element 122 and the second tube element 124 are in communication with each other. The input end 122*a* and the first output end 122*b* are formed at the first tube element 122. The input end 122*a* is located on the outer surface 112*a* of the wall plate 112 and is in communication with the external environment. The first output end 122*b* is located on the inner surface 112*b* of the wall plate 112 and is aligned with the first cavity 132 of the microphone assembly 130. The second output end 124*a* is formed at the second tube element 124 and is in communication with the adjustment cavity 140.

Figure 3:
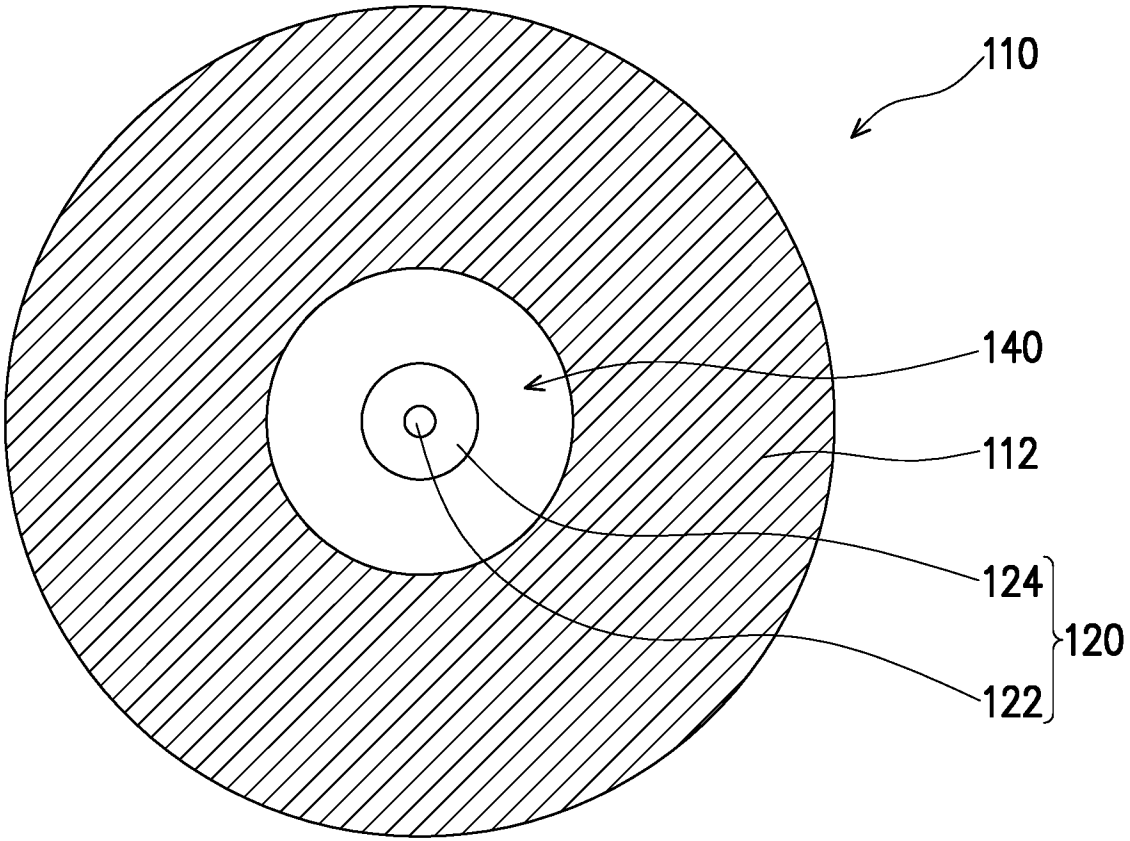
FIG. 3 is a cross-sectional view of the electronic device taken along a line A-A of FIG. 2.

FIG. 3 is a cross-sectional view of the electronic device taken along a line A-A of FIG. 2. Referring to FIG. 3, in the embodiment, the adjustment cavity 140 is ring-shaped, for example, and surrounds the sound guiding tube 120 to locate the sound guiding tube 120 at the geometric center of the adjustment cavity 140. The second tube element 124 of the sound guiding tube 120 is ring-shaped, for example. In addition, with the first tube element 122 being the geometric center, the second tube element 124 extends to the adjustment cavity 140 in a radial direction D2. The second tube element 124 is disposed around the periphery of the first tube element 122. The adjustment cavity 140 is disposed around the periphery of the second tube element 124. The second tube element 124 is located between the first tube element 122 and the adjustment cavity 140 and is in communication with the first tube element 122 and the adjustment cavity 140. In other embodiments, the adjustment cavity 140 and/or the second tube element 124 are not required to be ring-shaped. That is, the invention is not particularly limited in this regard.

In the embodiment, the volume of the adjustment cavity 140 is greater than the volume of the first cavity 132 and greater than the volume of the second tube element 124. Accordingly, the adjustment cavity 140 is provided with a sufficient volume to effectively attenuate the energy generated through the wall plate 112 reflecting acoustic waves, thereby reducing the frequency response gain resulting from the reflection of the acoustic waves by the wall plate 112. In addition, the volume of the first tube element 122 is greater than the volume of the second tube element 124. Therefore, the first tube element 122 is provided with a sufficient volume to effectively transmit the acoustic waves from the external environment to the microphone assembly 130. Specifically, the dimension of the second tube element 124 is smaller than the dimension of the adjustment cavity 140 in a direction parallel to an axial direction D1 of the first tube element 122, and the dimension of the second tube element 124 is smaller than the dimension of the adjustment cavity 140 in a direction parallel to the radial direction D2 of the first tube element 122. Accordingly, the volume of the first tube element 122 is greater than the volume of the second tube element 124.

In the embodiment, if the volume of the adjustment cavity 140 is defined as C, the area of the cross section of the second tube element 124 perpendicular to the radial direction of the first tube element 122 is defined as A, and the length of the second tube element 124 along the radial direction of the first tube element 122 is defined as L, C*A/L is designed to be smaller than the square of the speed of sound. Accordingly, the second tube element 124 is in communication with the adjustment cavity 140 to effectively attenuate the energy generated through the wall plate 112 reflecting the acoustic waves, while the reception of the acoustic waves by the microphone assembly 130 from the external environment through the first tube element 122 remains unaffected.

In the embodiment, the resonance frequency of the adjustment cavity 140 and the second tube element 124 with respect to the acoustic waves is related to the volumes thereof. Therefore, the volumes of the adjustment cavity 140 and the second tube element 124 may be determined according to the amount of the frequency response gain resulting from the reflection of the acoustic waves by the wall plate 112.

In the embodiment, a circuit board 150 is disposed between the microphone assembly 130 and the inner surface 112*b* of the wall plate 112. The circuit board 150 is provided to process signals received by the microphone assembly 130. The circuit board 150 has a through hole 150*a* located below the first output end 122*b* and is in communication with the first cavity 132 of the microphone assembly 130. Accordingly, the first cavity 132 of the microphone assembly 130 is in communication with the first tube element 122 of the sound guiding tube 120.

Figure 4:
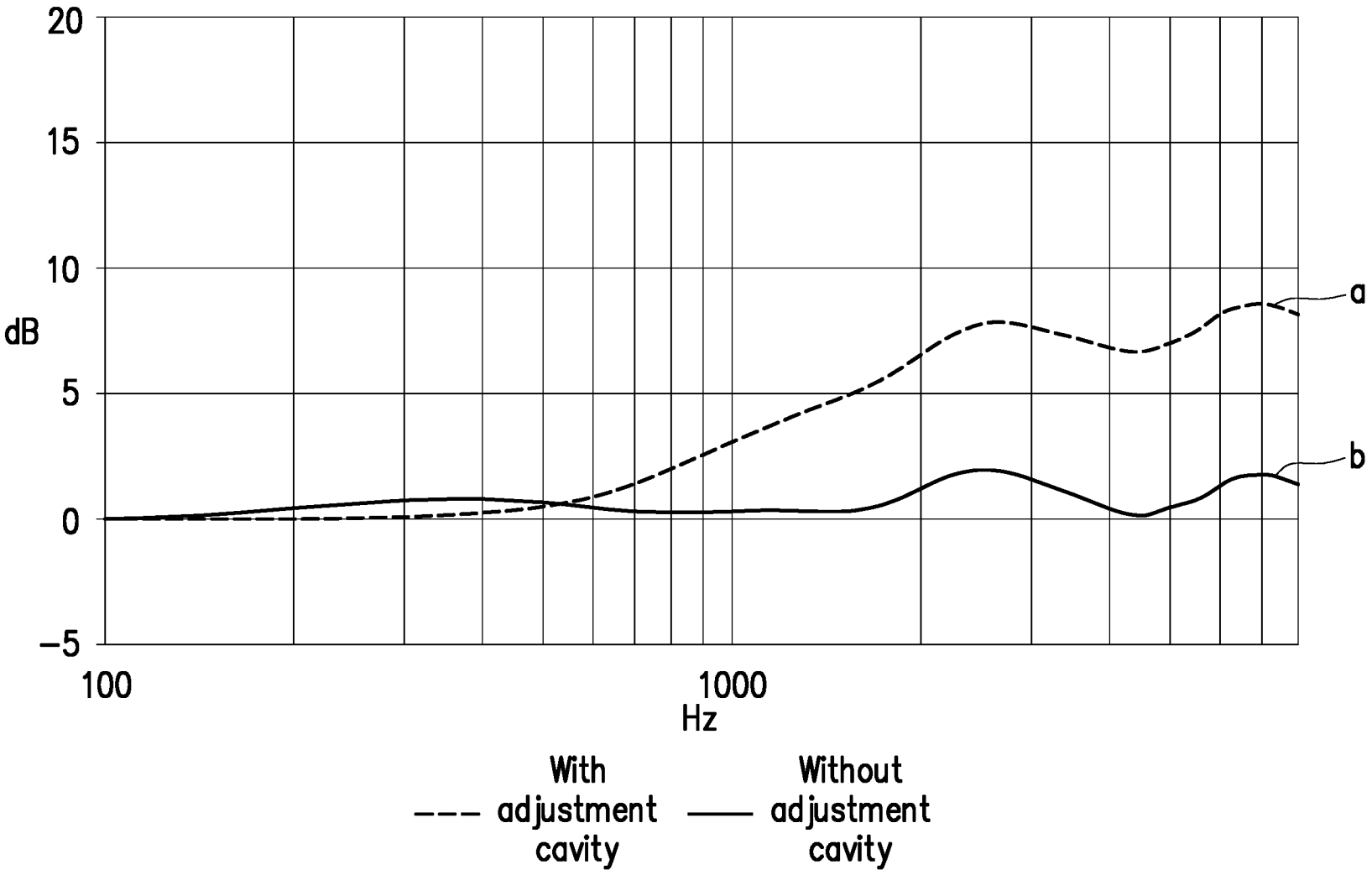
FIG. 4 is a diagram illustrating the result of attenuating, by an adjustment cavity of FIG. 1, the energy generated through a wall plate reflecting acoustic waves.

FIG. 4 is a diagram illustrating the result of attenuating, by an adjustment cavity of FIG. 1, the energy generated through a wall plate reflecting acoustic waves. Referring to FIG. 4, in the case of the wall plate 112 whose diameter is 100 millimeters, with the adjustment cavity 140 attenuating the energy generated through the wall plate 112 reflecting the acoustic waves, the frequency response gain resulting from the reflection of the acoustic waves by the wall plate 112 is reduced from a gain a to a gain b. Accordingly, the unfavorable gain in mid to high frequencies is alleviated.

In view of the above, in the electronic device according to the embodiments of the invention, the adjustment cavity in communication with the second output end of the sound guiding tube is disposed in the main body. Therefore, during the process in which the microphone assembly receives sounds, the energy generated through the wall plate reflecting acoustic waves may be attenuated by the adjustment cavity, so as to reduce the frequency response gain resulting from the reflection of the acoustic waves by the wall plate and render a favorable sound reception fidelity.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An electronic device, comprising:

a main body, comprising a wall plate;

a sound guiding tube, formed on the wall plate of the main body and comprising an input end, a first output end and a second output end, wherein the input end is in communication with an external environment;

a microphone assembly, disposed on the main body and in communication with the first output end of the sound guiding tube, wherein the microphone assembly is acoustically connected to the external environment; and an adjustment cavity, disposed in the main body and in communication with the second output end of the sound guiding tube, wherein the adjustment cavity is acoustically connected to the external environment.

2. The electronic device as claimed in claim 1, wherein the microphone assembly has a first cavity, and a volume of the adjustment cavity is greater than a volume of the first cavity.

3. The electronic device as claimed in claim 1, wherein the adjustment cavity is ring-shaped and surrounds the sound guiding tube.

4. The electronic device as claimed in claim 1, wherein the sound guiding tube comprises a first tube element and a second tube element, the sound guiding tube is connected to the microphone assembly via the first tube element and connected to the adjustment cavity via the second tube element.

5. The electronic device as claimed in claim 4, wherein a volume of the first tube element is greater than a volume of the second tube element.

6. The electronic device as claimed in claim 4, wherein the input end and the first output end are formed at the first tube element, the second output end is formed at the second tube element, and the first tube element and the second tube element are in communication with each other.

7. The electronic device as claimed in claim 4, wherein a volume of the second tube element is smaller than a volume of the adjustment cavity.

8. The electronic device as claimed in claim 4, wherein a dimension of the second tube element is smaller than a dimension of the adjustment cavity in a direction parallel to an axial direction of the first tube element.

9. The electronic device as claimed in claim 4, wherein a dimension of the second tube element is smaller than a dimension of the adjustment cavity in a direction parallel to a radial direction of the first tube element.

10. The electronic device as claimed in claim 4, wherein a volume of the adjustment cavity is defined as C, an area of a cross section of the second tube element perpendicular to a radial direction of the first tube element is defined as A, a length of the second tube element along the radial direction of the first tube element is defined as L, and C*A/L is smaller than a square of a speed of sound.

* * * * *